US007052361B2

(12) United States Patent
Fath et al.

(10) Patent No.: US 7,052,361 B2
(45) Date of Patent: May 30, 2006

(54) METHOD FOR HYDRO-EROSIVE ROUNDING OF AN EDGE OF A PART AND USE THEREOF

(75) Inventors: Andreas Fath, Erlangen (DE); Wilhelm Frank, Bambeg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/891,595

(22) Filed: Jul. 15, 2004

(65) Prior Publication Data

US 2005/0003740 A1 Jan. 6, 2005

Related U.S. Application Data

(63) Continuation of application No. PCT/DE2003/002190, filed on Jul. 1, 2003.

(30) Foreign Application Priority Data

Jul. 3, 2002 (DE) ..... 102 29 897

(51) Int. Cl.
*B24B 1/00* (2006.01)

(52) U.S. Cl. ..... 451/2; 451/38

(58) Field of Classification Search ..... 451/38, 451/39, 40, 36, 2, 5

See application file for complete search history.

(56) References Cited

U.S. PATENT DOCUMENTS

| | | | | |
|---|---|---|---|---|
| 5,964,644 | A * | 10/1999 | Rhoades | 451/40 |
| 5,971,835 | A * | 10/1999 | Kordonski et al. | 451/38 |
| 6,132,482 | A * | 10/2000 | Perry | 51/293 |
| 6,306,011 | B1 * | 10/2001 | Perry et al. | 451/38 |
| 6,575,815 | B1 * | 6/2003 | Schubert et al. | 451/38 |

FOREIGN PATENT DOCUMENTS

| | | |
|---|---|---|
| DE | 199 02 422 A1 | 8/2000 |
| DE | 199 40 291 A1 | 3/2001 |
| DE | 0 844 920 T1 | 4/2001 |
| DE | 100 15 875 A1 | 10/2001 |
| EP | 0 402 886 A1 | 6/1990 |
| EP | 1 186 377 A2 | 9/2001 |
| WO | WO 87/05552 | 9/1987 |

* cited by examiner

*Primary Examiner*—Jacob K. Ackun, Jr.
(74) *Attorney, Agent, or Firm*—Baker Botts L.L.P.

(57) ABSTRACT

In a method for the hydro-erosive rounding of an edge of a part, particularly an edge in a duct of a high pressure-resistant part, and a use thereof, a liquid to which abrasive elements are added is directed along the edge that is to be rounded. In order to optimize the result of the rounding process, a high-viscosity liquid is used as a liquid (10). The inventive method is used for rounding parts of a fuel injection system.

16 Claims, 2 Drawing Sheets

METHOD FOR HYDRO-EROSIVE ROUNDING OF AN EDGE OF A PART AND USE THEREOF

CROSS REFERENCE TO RELATED APPLICATION

This application is a continuation of copending International Application No. PCT/DE2003/002190 filed Jul. 1, 2003 which designates the United States, and claims priority to German application no. 102 29 897.1 filed Jul. 3, 2002.

TECHNICAL FIELD OF THE INVENTION

The present invention relates to a method for the hydro-erosive rounding of an edge of a part, particularly an edge in a duct of a high-pressure resistant part, whereby a liquid to which abrasive elements are added is directed along the edge that is to be rounded. The invention also relates to a use of the said method.

DESCRIPTION OF THE RELATED ART

It is generally known that in the case of high-pressure resistant parts, such as for example injection nozzles for diesel fuel, the injection holes for the fuel disposed in the area of a nozzle needle seat of the injection nozzle are eroded into the housing of the injection nozzle. Once the injection holes of the diesel injection nozzle have been eroded, they (especially their inlet edges) are hydro-erosively rounded, in order to counter the occurrence of local peak stresses leading to component fatigue. Hydro-erosive rounding is a liquid abrasion process in which abrasive particles are added to a liquid, preferably an oil, which flows through the injection holes under pressure, so that the inlet edges of the injection holes are rounded. This abrasion process firstly achieves the object of setting the flow coefficient of the injection holes and thus optimizing the efficiency of the injection nozzle. To this end a desired target flow coefficient is set, the flow tolerance also being reduced. Secondly the ageing process occurring in motor operation of the injection nozzle is anticipated, so that in operation this only occurs to a minor extent. In recent years it has been shown that particularly good emission and performance values are achieved with injection nozzles having a high level of efficiency. An increase in efficiency can be achieved by a higher degree of rounding.

However, a disadvantage of this is that with the standard oil used to date as an abrasive liquid only comparatively small degrees of rounding can be achieved, since when the supply pressure of the abrasive liquid is raised elutriations can be observed as a function of the flow and pressure ratios in the area of the edge to be rounded and these result in an eccentricity of the injection holes and thus in a reduction in efficiency.

The risk of elutriations can for example be avoided by an ExtrudeHone method for rounding, whereby an abrasive paste is pressed through the injection holes. Very high degrees of rounding can be achieved with this abrasion process, without resulting in elutriations.

The drawback with this is that the flow of the abrasive paste cannot be determined during the abrasion process, which has an adverse effect on adjusting the flow precision of the injection holes. In addition the injection nozzles must be thoroughly cleaned after this process, so that no residue of abrasive paste remains in the nozzles and the injection holes thereof. Residues of this type can result in the injection holes becoming blocked or the nozzle being prevented from being sealed by the nozzle needle.

Another known variant to avoid elutriations involves considerably reducing the abrasive pressure of the erosive liquid by reducing the speed of flow. As a result abrasion times increase phenomenally and the quality achieved still leaves a lot to be desired. In another variant it is also possible to round hydro-erosively using back-pressure. Though the elutriations are then smaller, the amount of apparatus required for the rounding device is larger. Moreover, in this variant too, the abrasion times are very long and thus not suitable for a production process.

It is also generally known that when manufacturing high-pressure resistant injection nozzle for fuels, a circumferential edge arises in the area where the guide bore for the nozzle needle and the fuel feed bore running into the guide bore at an acute angle and entering the guide bore intersect. The guide bore is frequently widened in the entry area to create a high-pressure chamber. The web-like area of the edge enclosed between guide bore and fuel feed bore is also known as a wedge. The edge or the wedge is known to be a location at which local peak stresses occur under load which can result in a failure of the injection nozzles. In order to make the injection nozzles more resistant to high-pressure, the edge with the wedge must be rounded. Various methods for this are generally known in the prior art. In the case of injection nozzles used at an operating pressure of up to approximately 1600 bar, edge and wedge are rounded by means of electrochemical machining (ECM). This electrochemical machining is also used to widen the guide bore to create the high-pressure chamber. A high-pressure resistance of above 1600 bar cannot be achieved with electrochemical machining because this process creates a pore-like rough surface resulting in local peak stresses. Another variant to increase the high-pressure resistance involves manufacturing so-called tapered seat nozzles. Here a stress is introduced into the injection nozzle during assembly which counters the compressive stress in operation of the injection nozzle, so that overall the high-pressure resistance of the injection nozzle can be increased. In combination with the previously described electrochemical machining the high-pressure resistance of the injection nozzle can be raised to approximately 1800 bar. Injection nozzles with pressure resistances of more than 1800 bar are highly rounded on the wedge with the aid of a paste to which abrasive particles are added. To this end the paste is pressed via the fuel feed bore through the body of the injection nozzle and out of the guide bore. This method is also known as ExtrudeHone. However, the problem here is that considerable effort is required to clean the injection nozzle in order to remove the abrasive paste remaining in the injection nozzle after rounding. There is also a risk that residues of the paste are left in the injection nozzle and the injection holes disposed at the end of the guide bore for the injection nozzle are blocked or the nozzle needle loses its sealing function as a result of the remaining paste.

Furthermore German patent application DE 199 53 131 A1 discloses a method and a device for rounding edges in mechanically, thermally or otherwise highly stressed parts. A special area of application is stipulated as rounding edges at intersections of ducts in high-pressure reservoirs of fuel injection systems. In such highly stressed parts, peak stresses occur in the area of edges of all kinds, which can result in component failure, in particular rupturing of the component. To design the part to be high-pressure resistant, its edges are rounded. The rounding is done by passing an erosive liquid over the edge to be rounded, said liquid being fed through the part by a supply pump. In order to increase the erosive effect of the liquid in the area of the edge, the flow speed of the liquid is increased by means of a cross-sectional constriction. By adjusting the supply pressure the flow speed of the liquid can be affected, and thus also the removal of material in the area of the edge. The supply pressures are approximately in the range between 50 bar and 140 bar. In addition, it is indicated in this connection without further details that the direction of flow of the liquid and the longitudinal axis of the edge to be rounded preferably embrace an angle of 90°. For rounding the edge-like transition of a nozzle needle seat and of an adjacent antechamber to the injection holes of an injection nozzle, a description is given there of inserting a conical body into the area of the nozzle needle seat of the blind-hole-type injection nozzle so that an annular gap occurs in the area of the edge. This annular gap serves to achieve the desired increase in the speed of flow in the area of the edge to be rounded.

SUMMARY OF THE INVENTION

The object of the present invention is to create a method for hydro-erosive rounding of an edge of a part, in particular of an edge in a duct of a high-pressure resistant part, and a use thereof, with which optimum rounding results can be achieved.

This object can be achieved by a method for hydro-erosive rounding of an edge of a part, in particular of an edge in a duct of a high-pressure resistant part, comprising the step of directing a liquid to which abrasive elements have been added along the edge to be rounded, wherein the liquid is a high-viscosity liquid.

The liquid may have a viscosity in the range between 10 and 100 $mm^2/s$, preferably a viscosity of approximately 50 $mm^2/s$. In a first abrasion method using the high-viscosity liquid abrasion may take place up to a definable distance from a desired target value, and subsequently in a second abrasion process using a test oil to which abrasive particles have been added, abrasion takes place up to the desired target value. In order to check on and control the progress of the rounding process in the case of a pre-set and as constant as possible volume flow of the liquid the pressure occurring in the liquid can be measured and the rounding procedure can be terminated when a preselected pressure is reached in the liquid. The method can be used for parts of a fuel injection system, wherein the part of the fuel injection system to be rounded can be an edge, in particular a wedge, in the area of intersection between a fuel feed bore and a guide bore of an injection nozzle. The part of the fuel injection system to be rounded can also be an edge in the area of the injection hole of an injection nozzle. The liquid may have a pressure of 40 to 300 bar.

According to the invention, a method for hydro-erosive rounding of an edge of a part, in particular of an edge in a duct of a high-pressure resistant part, in which a liquid to which abrasive elements are added is directed along the edge to be rounded, means that a high-viscosity liquid is used as a liquid, that fast abrasion times can be achieved and that the risk of elutriations by the liquid in the duct is very small. In a preferred embodiment of the invention the liquid has a viscosity in the range between 10 and 100 $mm^2/s$, preferably approximately 50 $mm^2/s$.

Advantageously the parts rounded hydro-erosively using the inventive method, in particular injection nozzles for fuels, achieve a high-pressure resistance of over 1800 bar. The oil can also be dissolved in other oils, such as diesel or diesel-like oils, so that after the rounding process the part is easy to clean. Expensive cleaning processes in comparison to the ExtrudeHone method can be dispensed with. After the rounding procedure it is sufficient to flush the part with oil to remove any remaining abrasive elements. Disposal is simpler (no hazardous waste) and the high viscosity ensures a homogeneous distribution of the abrasion particles which is stable over time. These requirements are met by most organic oils. The abrasion times are also considerably reduced, so that cycle times are achieved which enable the rounding method to be used in production processes. Abrasion times can be kept selectively low and the roughness to be achieved can be selectively varied via the supply pressure, the concentration and size of abrasive elements, the viscosity of the abrasion oil and the flow speed of the abrasion oil.

In a preferred embodiment of the invention it is provided that to check on and control the progress of the rounding process in the case of a pre-set and as far as possible constant volume flow of the liquid the pressure occurring in the liquid is measured and the rounding procedure is terminated when a preselected pressure is achieved in the liquid. Thus it is possible to use this method in the production process and desired degrees of rounding can be selectively achieved. In particular, this type of control is suitable for rounding injection holes in an injection nozzle for fuels. It is now also easier to adapt this method to the geometric and hydraulic circumstances of other components.

Advantageously the inventive rounding method for parts of a fuel injection system can be used to increase the high-pressure resistance there to over 1800 bar. A part of the fuel injection system particularly suitable for rounding is an edge, in particular a wedge, in the area of intersection of a fuel feed bore and a guide bore of an injection nozzle or an edge in the area of the injection hole of an injection nozzle.

It is also possible to execute the inventive abrasion method at largely freely selectable abrasion pressures, so that different types of nozzle can be rounded at the wedge using one liquid. For example, low abrasion pressures can be used for parts whose edges are to be only slightly rounded and high abrasion pressures can be used for nozzles which are to be considerably rounded.

BRIEF DESCRIPTION OF THE DRAWINGS

The present invention is explained below in greater detail on the basis of an embodiment shown in a drawing. This shows.

DETAILED DESCRIPTION OF THE PREFERRED EMBODIMENTS

The inventive method for hydro-erosive rounding of edges in high-pressure resistant parts uses a high-viscosity liquid to which abrasive elements are added. Suitable high-viscosity liquids are abrasion oils with a viscosity in the range between 10 and 100 $mm^2/s$, preferably approximately 50 $mm^2/s$. A hydrocarbon oil can be used, for example. The liquid is fed to the edges in the area of high pressure resistant parts via a supply pump (not shown) working at a supply pressure of approximately 10 to 500 bar, preferably 100 bar.

By adjusting the supply pressure and the flow speed of the liquid the speed and degree of rounding can be influenced.

Figure 1:
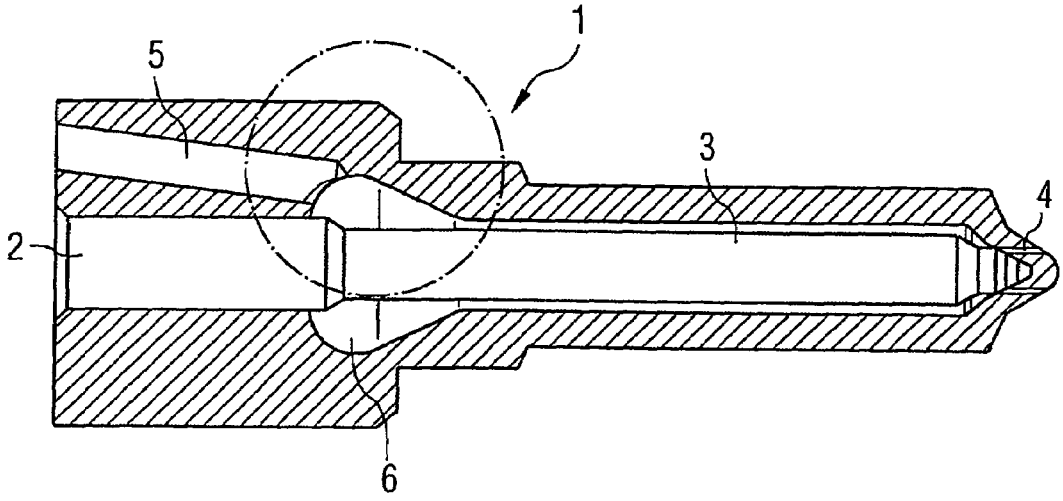
FIG. 1—a sectional view of a high-pressure resistant injection nozzle for fuels, FIG. 2—an enlargement of a segment of FIG. 2 from the area of the fuel feed bore of the injection nozzle, and FIG. 3—a diagram showing the flow coefficient of the injection holes over the degree of rounding for different abrasion oils.

The inventive rounding method is described below in greater detail in use for an injection nozzle 1 for diesel fuel. FIG. 1 shows a sectional view of a high-pressure resistant injection nozzle 1 for diesel fuel. The overall elongated injection nozzle 1 has a guide bore 2 placed centrally for the nozzle needles 3, which in each case extend lengthwise parallel to the longitudinal axis of the injection nozzle 1. The nozzle needle 3 can be moved in the longitudinal direction in the guide bore 2, in order to be able to close and open the injection holes 4 disposed in the area of a nozzle needle seat at the front end of the injection nozzle 1. A fuel feed bore 5, which is directed lengthwise in essence to the front end of the injection nozzle 1, enters the guide bore 2 at an acute angle. In the area in which the fuel feed bore 5 enters the guide bore 2, the guide bore 2 expands to form a high-pressure chamber 6.

Figure 2:
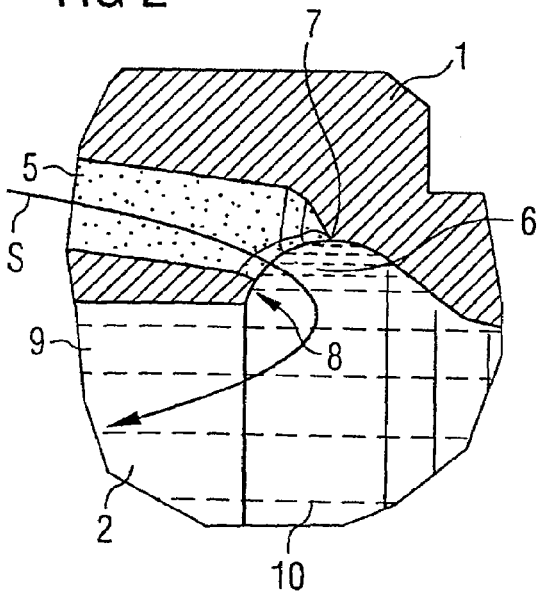
Figure 3:
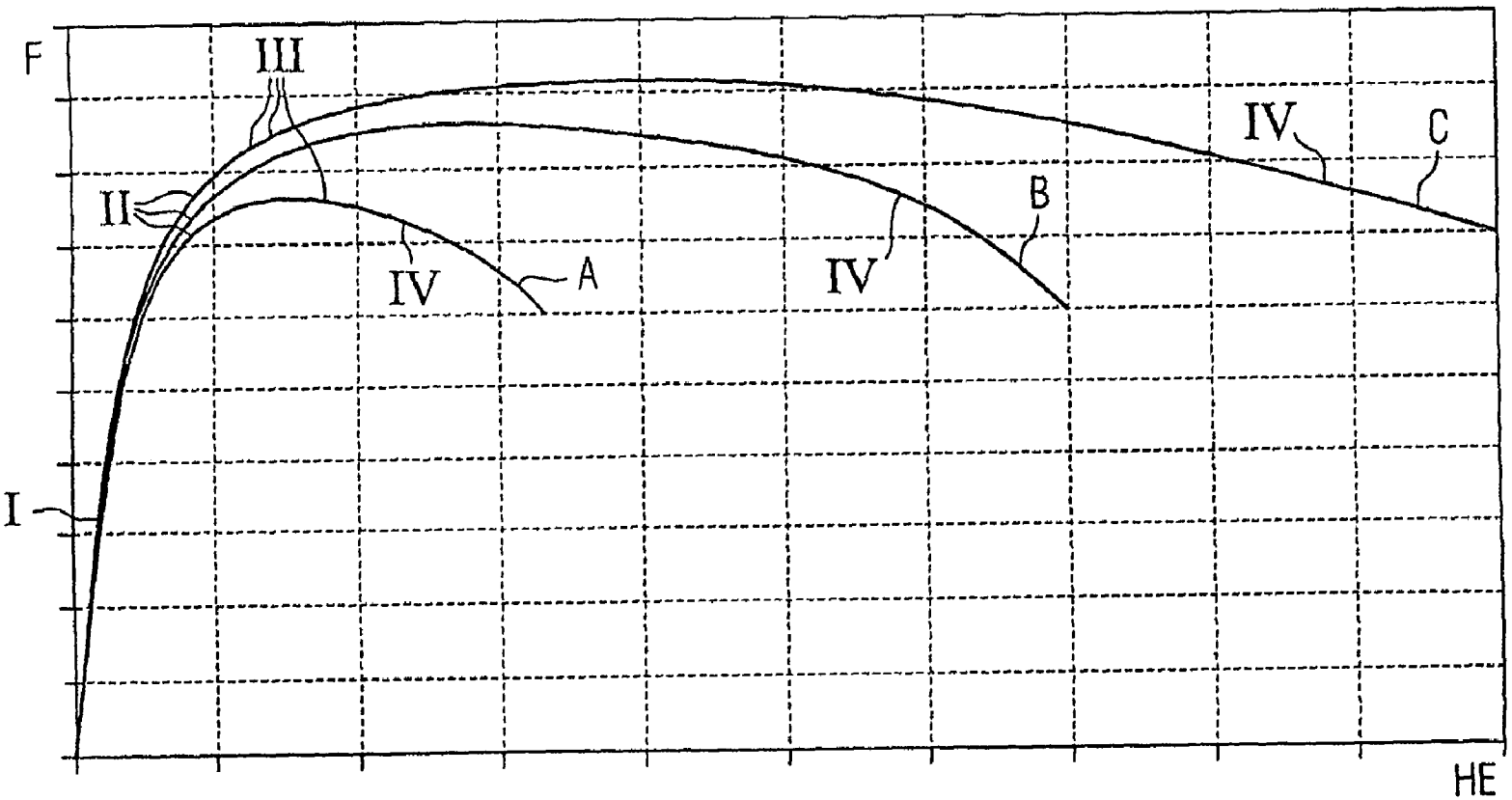

This entry area of the injection nozzle 1 is shown in detail in FIG. 3, which shows an enlargement of a segment of FIG. 2 from the area of the fuel feed bore 5 of the injection nozzle 1. It is apparent that the fuel feed bore 5, the guide bore 2 and the high-pressure chamber 6 intersect one another, so that a circumferential edge 7 arises during production. The web-like area of the circumferential edge 7, which faces the guide bore 2, is also called a wedge 8. To increase the high-pressure resistance of the injection nozzle 1 this edge 7 with the wedge 8 is rounded by means of a high-viscosity liquid 10 to which abrasive elements 9 have been added. To this end the liquid 10 is fed at high pressure into the fuel feed bore 5, flows through the fuel feed bore 5, is diverted in the area of the circumferential edge 7 and of the wedge 8 and leaves the guide bore 2 at the end facing away from the injection holes 4. This previously described flow route of the liquid 10 is represented in FIG. 2 by the arrow S. In the area of the diversion of the liquid 10 the edge 7 or the wedge 8 is rounded by abrasive elements 9 contained in the liquid 10, said abrasive elements striking the edge 7 or wedge 8.

Naturally other high-pressure resistant parts with related geometries similar to the previously described wedge 9 can likewise be rounded using the inventive method. This new method can also be combined with other means in order to design parts to be high-pressure resistant, such as tapered seat nozzles for example.

FIG. 3 shows a diagram showing the flow coefficient HD of the injection holes 4 (see FIG. 2) over the degree of rounding HE for a standard abrasion oil A and two inventive high-viscosity abrasion oils B and C with increasing viscosity in the range between 2 and 100 $mm^2/s$. Hydrocarbon oils or synthetic oils can for example be used as abrasion oils B and C. The degree of rounding HE is in direct proportion to the rounding time. From FIG. 3 it is clear that the hydro-erosive abrasion process is split into different phases I to IV. Initially in a first phase I the inlet edge of the injection hole 4 of the injection nozzle 1 is rounded. In a second phase II the peaks of roughness in the injection holes 4 are smoothed, following which in a third phase III the diameter is increased in controlled fashion. In the fourth and last phase IV the injection holes are elutriated in uncontrolled fashion. Flow ducts are formed, resulting in a deviation of the injection holes 4 from roundness.

These individual phases referred to above strongly affect the flow coefficient HD of the nozzle 1 with the injection holes 4, which is proportional to the efficiency of the nozzle 1. In the first two phases the efficiency increases, then in the third phase it stagnates, and falls again in the fourth phase. It is also apparent that the maximum efficiency can be affected by using different abrasion oils A, B and C. It is in particular apparent that higher degrees of rounding HE and thus also better flow coefficients F of the injection nozzle 1 can be achieved with the inventive high-viscosity abrasion oils B and C. The higher degrees of rounding HE are also accompanied by an improved high-pressure resistance of the injection nozzle 1.

FIG. 3 also shows that with the inventive high-viscosity abrasion oils B and C there is a lower risk of elutriations occurring during the abrasion procedure in the area of Phase IV. Additionally the rounding times can be considerably reduced because of the optimized abrasion effect, so that cycle times are achieved which enable this rounding method to be used in production processes.

Also, particularly in connection with the rounding of injection holes 4, the hydraulic flow of the abrasive liquid can be measured during the abrasion procedure, so that it is possible to check on and selectively control the rounding method. Two methods of measuring are suitable here. Firstly, in the case of a predefined constant volume flow of the abrasive liquid the pressure occurring during the abrasion procedure can be measured. If a desired pressure is achieved, the abrasion procedure is terminated. In this way the desired target value of the hydraulic flow can be set very precisely. The target value for the hydraulic flow is linked to a target range for a desired degree of rounding or flow coefficient.

Secondly, in the case of a continuously predefined pressure, the volume flow can be measured. When a desired volume flow is reached the abrasion procedure is terminated. Similarly to the first method the desired hydraulic flow is set at a corresponding degree of rounding or flow coefficient. The first method referred to is preferred, since the measurement of the pressure produces more reliable results.

As regards the choice of abrasion oil and checks on and selective control of the rounding method by measuring the hydraulic flow of the abrasive liquid during the abrasion procedure, it should be noted that on the basis of the pressure ratios and the flow geometry in the part to be rounded the abrasion oil can flow in a 1-phase flow or a 2-phase flow. For example, in one instance of use a standard abrasion oil can flow in the form of a 2-phase flow during the abrasion procedure, whereas under identical basic conditions an inventive high-viscosity abrasion oil does not cavitate and is present as a 1-phase flow. It is known that the flow behavior of a 1-phase flow differs significantly compared to a 2-phase flow. This has a crucial effect on the flow coefficient F occurring.

In the above case no steady correlation can be found between the standard abrasion oil and the high-viscosity abrasion oil. If both oils cavitate or both do not cavitate there is a clear correlation in each case. With this knowledge it is now possible to search for the ideal abrasion oil. It is important that the oil used has the highest viscosity possible, in order to minimize elutriations and achieve fast abrasion times.

If required a two-stage abrasion method is advantageous. In the first stage abrasion takes place using a high-viscosity liquid up to a definable distance, for example 5%, from a target value. Then in the second stage abrasion takes place up to the target value using a target liquid. The target liquid corresponds to a test oil used for testing the hydraulic flow, and to which abrasive particles are added.

In addition to rounding all possible injection holes, further possible uses include rounding throttles in injector bodies. This method can of course also be used for high-pressure resistant parts in the field of internal combustion engines.

We claim:

1. A method for hydro-erosive rounding of an edge of a part, comprising the step of directing a liquid to which abrasive elements have been added along the edge to be rounded, wherein the liquid is a high-viscosity liquid having a viscosity in the range between 10 and 100 mm2/s.

2. The method according to claim 1, wherein the liquid has a viscosity of approximately 50 mm2/s.

3. The method according to claim 1, wherein in a first abrasion method using the high-viscosity liquid abrasion takes place up to a definable distance from a desired target value, and subsequently in a second abrasion process using a test oil to which abrasive particles have been added, abrasion takes place up to the desired target value.

4. The method according to claim 1, wherein in order to check on and control the progress of the rounding process in the case of a pre-set and as constant as possible volume flow of the liquid the pressure occurring in the liquid is measured and the rounding procedure is terminated when a preselected pressure is reached in the liquid.

5. The method according to claim 1, wherein the method is used for parts of a fuel injection system.

6. The method according to claim 5, wherein the part of the fuel injection system to be rounded is an edge, in particular a wedge, in the area of intersection between a fuel feed bore and a guide bore of an injection nozzle.

7. The method according to claim 5, wherein the part of the fuel injection system to be rounded is an edge in the area of the injection hole of an injection nozzle.

8. The method according to claim 1, wherein the liquid has a pressure of 40 to 300 bar.

9. A method for hydro-erosive rounding of an edge in a duct of a high-pressure resistant part, comprising the step of directing a liquid to which abrasive elements have been added along the edge to be rounded, wherein the liquid is a high-viscosity liquid having a viscosity in the range between 10 and 100 mm2/s.

10. The method according to claim 9, wherein the liquid has a viscosity of approximately 50 mm2/s.

11. The method according to claim 9, wherein in a first abrasion method using the high-viscosity liquid abrasion takes place up to a definable distance from a desired target value, and subsequently in a second abrasion process using a test oil to which abrasive particles have been added, abrasion takes place up to the desired target value.

12. The method according to claim 9, wherein in order to check on and control the progress of the rounding process in the case of a pre-set and as constant as possible volume flow of the liquid the pressure occurring in the liquid is measured and the rounding procedure is terminated when a preselected pressure is reached in the liquid.

13. The method according to claim 9, wherein the method is used for parts of a fuel injection system.

14. The method according to claim 13, wherein the part of the fuel injection system to be rounded is an edge, in particular a wedge, in the area of intersection between a fuel feed bore and a guide bore of an injection nozzle.

15. The method according to claim 13, wherein the part of the fuel injection system to be rounded is an edge in the area of the injection hole of an injection nozzle.

16. The method according to claim 9, wherein the liquid has a pressure of 40 to 300 bar.

* * * * *